US009127424B2

(12) United States Patent
James et al.

(10) Patent No.: US 9,127,424 B2
(45) Date of Patent: Sep. 8, 2015

(54) CONNECTING DEVICES

(75) Inventors: Dallas Rex James, Auckland (NZ); Jason Paul Rogers, Pukekohe (NZ)

(73) Assignee: LINDSAY TRANSPORTATION SOLUTIONS, INC., Omaha, NE (US)

( * ) Notice: Subject to any disclaimer, the term of this patent is extended or adjusted under 35 U.S.C. 154(b) by 375 days.

(21) Appl. No.: 13/480,166

(22) Filed: May 24, 2012

(65) Prior Publication Data

US 2012/0297589 A1 Nov. 29, 2012

(30) Foreign Application Priority Data

May 25, 2011 (NZ) ..... 593063

(51) Int. Cl.
*E01F 13/02* (2006.01)
*E01F 15/08* (2006.01)

(52) U.S. Cl.
CPC ..... *E01F 15/088* (2013.01); *Y10T 24/45288* (2015.01)

(58) Field of Classification Search
USPC ..... 404/6, 9; 256/13.1, 24, 25, 26, 27, 73; 403/92, 95, 96, 84, 150, 151, 355; 16/344, 347, 348, 358
See application file for complete search history.

(56) References Cited

U.S. PATENT DOCUMENTS

| | | | | |
|---|---|---|---|---|
| 3,767,167 | A * | 10/1973 | Rasmussen | 256/26 |
| 3,952,415 | A | 4/1976 | Samuel et al. | |
| 4,139,943 | A | 2/1979 | Dragan | |
| 4,681,302 | A * | 7/1987 | Thompson | 256/13.1 |
| 4,820,159 | A | 4/1989 | Weissman | |
| 4,836,143 | A * | 6/1989 | Shadbolt, Jr. | 119/514 |
| 4,844,424 | A * | 7/1989 | Knudslien | 256/26 |
| 5,425,594 | A * | 6/1995 | Krage et al. | 404/6 |
| 6,485,224 | B1 * | 11/2002 | Dyke et al. | 404/6 |
| 2010/0215427 | A1 * | 8/2010 | James | 403/161 |

FOREIGN PATENT DOCUMENTS

| | | |
|---|---|---|
| GB | 218091 | 9/1987 |
| GB | 218092 | 9/1987 |
| GB | 2188091 | 9/1987 |
| GB | 2188092 | 9/1987 |
| WO | 2008/147230 | 12/2008 |

OTHER PUBLICATIONS

Jim Michalak, "Small boat rudder" article, http://www.boatbuilding-links.de/Jim-Michaelak/kickup-rudder.htm.

* cited by examiner

*Primary Examiner* — Michael P Ferguson
(74) *Attorney, Agent, or Firm* — Thomas R. Lampe

(57) ABSTRACT

A connecting device is provided, including an elongate member (EM) having two or more engaging elements which are spaced along the length of the EM; and at least one engaging element which orthogonally extends out from the EM and which has a portion which also extends, in a direction substantially parallel to the longitudinal axis of the EM, a distance Y, wherein distance Y extends substantially 15-20% of the length of the EM.

6 Claims, 9 Drawing Sheets

CONNECTING DEVICES

STATEMENT OF CORRESPONDING APPLICATIONS

This application is based on the Provisional specification filed in relation to New Zealand Patent Application Number 593063, the entire contents of which are incorporated herein by reference.

TECHNICAL FIELD

The present invention relates to improvements in and relating to connecting devices.

BACKGROUND

The present invention relates to a connecting device which can be used for connecting adjacent barrier sections. However this should not be seen as limiting as the device may also have other applications.

For ease of reference only the present invention will now be described in relation to a connecting device used to connect adjacent temporary barrier sections. Temporary barrier sections are well known in the art and are typically used in relation to roading applications for separating traffic from pedestrians or for separating lanes of traffic from one another.

The present invention has particular application to a temporary barrier such as is disclosed in WO2008147230.

One of the key advantages of the barrier detailed in WO 2008147230 is the fact that a user can select in any given case for adjacent barrier sections whether a connection between the adjacent barrier sections is to create a pivotable, or fixed in-line, relationship between the barrier sections. Previous barrier sections could only create, one or other, of a fixed or pivotable connection, and could not switch between both, depending on the requirements of the user and barrier they were creating, from the barrier sections.

However, one potential improvement the applicant has realised that could be made to the barrier of WO 2008147230 is to make it easier to switch a connection from a pivotable connection to a fixed in-line type connection. Presently the WO 2008147230 barrier requires the connecting device in the form of a U-Shaped pin to be fully withdrawn before barriers can be adjusted to convert from a fixed in-line relationship between barrier sections to a pivotable relationship, or vice versa.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It is an object of the present invention to address the foregoing problems or at least to provide the public with a useful choice.

Further aspects and advantages of the present invention will become apparent from the ensuing description which is given by way of example only.

SUMMARY

According to one aspect of the present invention there is provided a connecting device which includes:

- an elongate member (EM) having a longitudinal axis of length X;
- at least one engaging element which orthogonally extends out from the EM and which has a portion which also extends, in a direction substantially parallel to the longitudinal axis of the EM, a distance Y, which is a fraction of length X of the EM.

The connecting device has particular application to joining adjacent barrier sections in a temporary barrier such as is taught in WO 2008147230. However, this should not be seen as limiting as the features of the connecting device of the present invention may also be useful in other applications. For ease of reference only the present invention will now be described in relation to use with a temporary barrier section such as is taught in WO 2008147230.

The EM may have a number of different configurations without departing from the scope of the present invention.

In preferred embodiments the EM may be in the form of a shaft. The shaft may have one or more different shaped cross sections. The shaft may be hollow or solid depending on the desired nature of the connecting device.

The engaging element may have a number of different configurations depending on the nature of the barrier sections it is being used to connect.

In one preferred embodiment the engaging element may be in the form of a dog leg element.

In another preferred embodiment the engaging element may be in the form of a plate.

The length Y the engaging element extends in a direction parallel to the longitudinal axis of the EM is governed by the fact that the connecting device of the present invention is designed to achieve a switch between a fixed relationship and a pivotable relationship between adjacent barrier sections whilst the barrier sections remain coupled by the connecting device.

In some embodiments the distance Y extends a distance which is less than 90% of the length X.

In preferred embodiments distance Y extends a distance which is less than substantially 50% of the length X.

In further preferred embodiments the distance Y extends less than substantially 30-40% of the length X.

In a most preferred embodiment distance Y extends substantially 15-20% of the length of X.

The length X of the EM is dependent on the size and/or type of barrier sections which the EM will be used to connect.

A connecting device substantially as described above having two or more engaging elements which are evenly spaced along the length of the EM.

A connecting device substantially as described above having three or more engaging elements which are evenly spaced along the length of the EM.

According to another aspect of the present invention, there is provided a barrier section adapted to used with a connecting device as described above which includes at least one connecting assembly at one or both ends of the barrier section, the connecting assembly comprising:

- connecting-region(s) including connecting device receiving portions (CDRP), wherein the connecting-region(s) are positioned to be capable of engaging, or being engaged, in use, with connecting-region(s) on an adjacent barrier section via the CDRP, via a single connecting device so that adjacent barrier sections can be selected to have either: an inline, or an angled relationship, with respect to one another;

the connecting regions at the respective ends of the barrier having differently-configured CDRP.

The connecting regions may come in a variety of different forms without departing from the scope of the present invention.

In some embodiments, the connecting region on one adjacent barrier may be in the form of a protrusion which is received by a connecting region on an adjacent barrier in the form of recess.

In preferred embodiments, the connecting-regions on both adjacent barriers may be in the form of protrusions.

In some preferred embodiments, the connecting-regions at opposite ends of a barrier section may be positioned at different relative heights so as to allow for a pair or pairs of protrusions on adjacent barrier sections to overlap with one another. The overlap allowing the connecting device receiving portions, which may be apertures, recess, slots, or the like, in the respective connecting-regions, to come into alignment with each other for receipt of the connecting device.

In other embodiments, the connecting regions at opposite ends on a barrier section may all be positioned at the same relative height which is higher or lower than the height of the connecting regions on an adjacent barrier section to which a connection is to be effected. Again the connecting regions on adjacent barrier sections may overlap with one another.

Thus, preferred embodiments of the present invention may have a number of advantages over the prior art which can include:

providing a connecting device which enables easier switching between adjacent barriers having a fixed (in-line) or pivotal (angled) relationship to one another;

partially lifting don't have to fully remove connector to adjust relationship between adjacent barrier sections. So can move between in-line to angled relationship or vice versa;

providing a barrier section which can be more easily moved between a fixed (in-line) or pivotal (angled) relationship to one another.

BRIEF DESCRIPTION OF THE DRAWINGS

Further aspects of the present invention will become apparent from the following description which is given by way of example only and with reference to the accompanying drawings in which.

DETAILED DESCRIPTION

Figure 1:
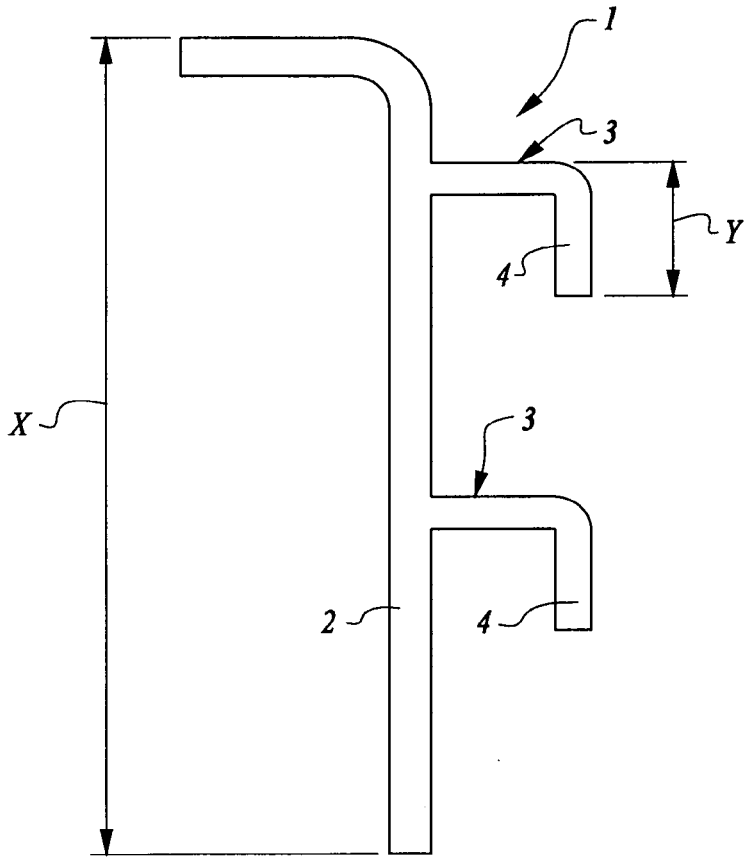
FIG. 1 shows a connecting-device in accordance with one preferred embodiment of the present invention.

In FIG. 1 there is shown a connecting device 1 which has an elongate member (EM) 2 having a length along its longitudinal axis, the length of which is depicted by double headed arrow X. Extending laterally out from the EM are two engaging elements in the form of dog legs 3. The engaging elements have a portion 4 which extends a distance Y which is parallel to the longitudinal axis of the EM.

Figure 2:
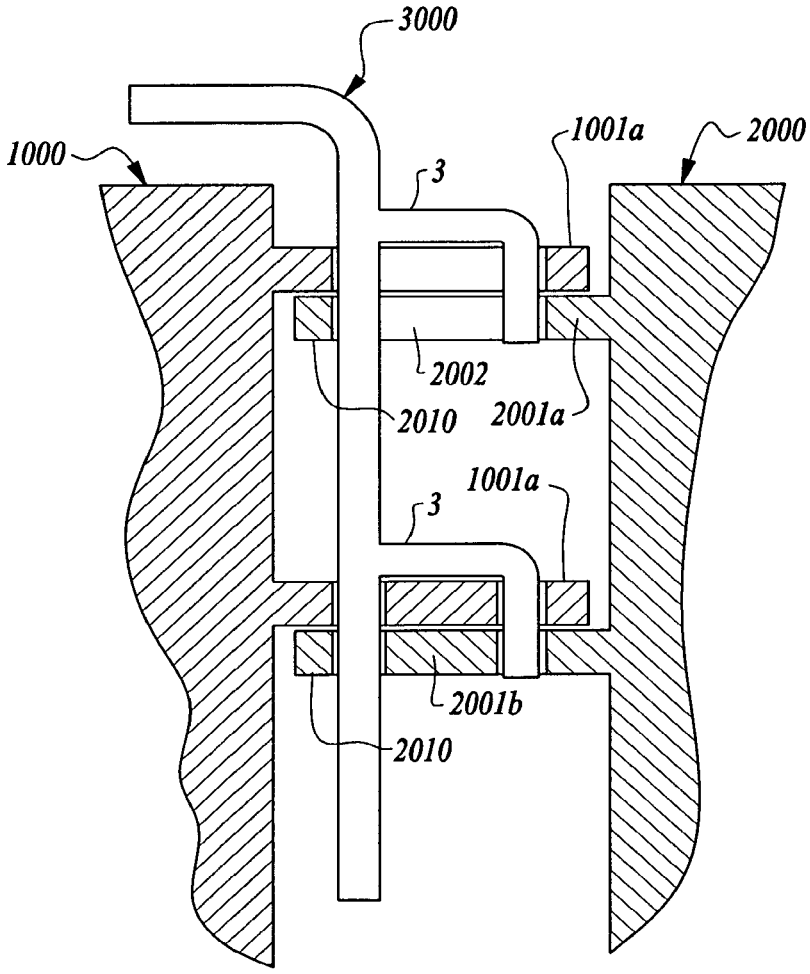
FIG. 2 shows a partial cross sectional side view of two adjacent barrier sections in accordance with a preferred embodiment of the present invention.

In FIG. 2 there are shown two adjacent barrier sections 1000 and 2000 which form part of a barrier (not shown). The barrier sections 1000 and 2000 each have two connecting regions 1001*a*, 1001*b* and 2001*a*, 2001*b* respectively. The connecting regions 1001*a*, 1001*b* and 2001*a*, 2001*b* are connected to one another via a connecting device 3000 which is the same as that shown in FIG. 1. It will be appreciated that the connecting regions 2001*a* and 2001*b* of the barrier section 2000 are replicated on the opposite end of barrier section 1000 which is not shown. Similarly the connecting regions 1001*a* and 1001*b* on barrier section 1000 are mirrored on the opposite end of barrier section 2000 which is not shown.

Figure 3:
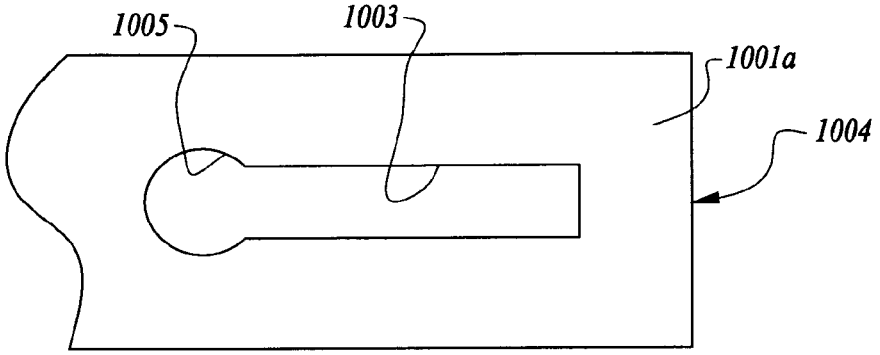
FIG. 3 shows a plan view of the top connecting-region on the left barrier section shown in FIG. 2.

In FIG. 3 the connecting region 1001*a* has a CDRP in the form of a slot 1003 which passes there through. The slot 1003 resembles a keyhole in shape and has a bulbous portion 1005. In use the slot 1003 allows the lower engaging portion 3 on the connector 1 to be passed down through without becoming hooked on the connecting region 1001*a*.

Figure 4:
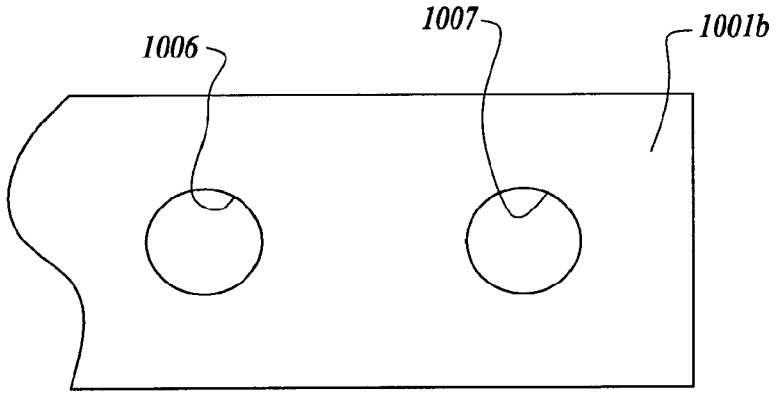
FIG. 4 shows a plan view of the top connecting-region on the right barrier section shown in FIG. 2.

The connecting region 1001*b* has a CDRP in the form of two circular apertures 1006, and 1007 which are shaped and dimensioned to receive the EM 2 and portion 4—refer to FIG. 4.

Figure 5:
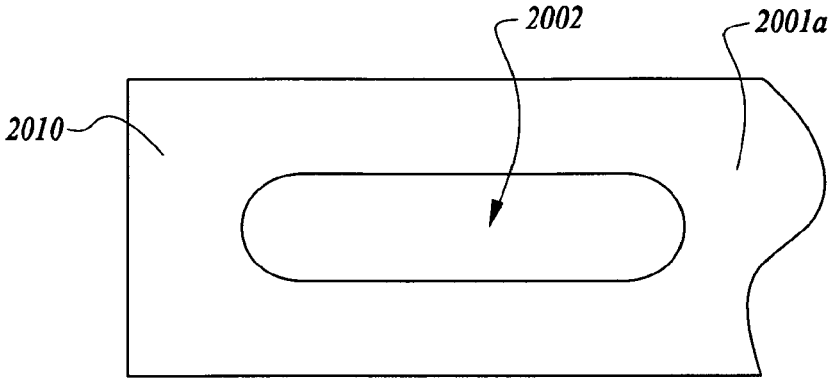
FIG. 5 shows a plan view of the bottom connecting-region on the left barrier section shown in FIG. 2.

The connecting region 2001*a* has a CDRP in the form of a slot 2002 through which the lower engaging portion on the EM 2 can pass—refer to FIG. 5.

Figure 6:
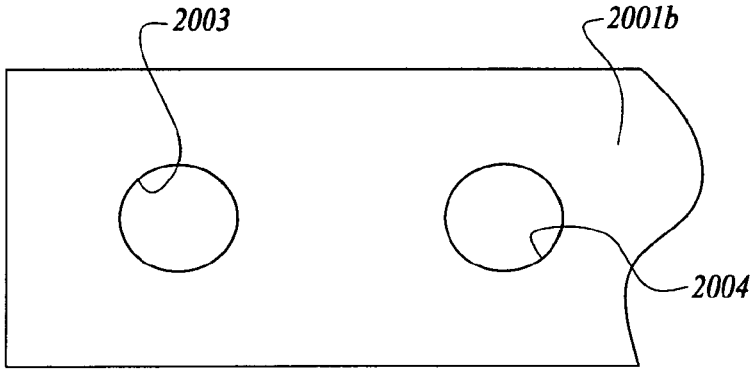
FIG. 6 shows a plan view of the bottom connecting-region on the left barrier section shown in FIG. 2.

The connecting region 2001*b* has a CDRP in the form of two circular apertures 2003 and 2004 which are shaped and dimensioned to receive the EM 2 and portion 4—refer to FIG. 6.

If it is desired to pivot one barrier section 1000 relative to barrier section 2000 so that they are connected to one another but in an angled relationship the connecting device 3000 is lifted until the engaging elements 3 are no longer engaged with slots 1003, 2002. The connecting device 3000 is then twisted to no longer align with slot 1003 before being allowed to drop and rest on the top of connecting regions 1001*a* and 1001*b*. The barrier section 1000 can then be pivoted relative to barrier section 2000 (or vice versa) to effect an angled relationship there between.

The relative amount that the connecting device 3000 needs to be lifted is the length of the engaging portions 4 as shown by double headed arrow Y in FIG. 1.

The connecting-region 2002 also has a stop-lip 2010 which abuts the end wall of barrier section 1000 to assist with aligning the aperture with slot 1003.

Figure 7:
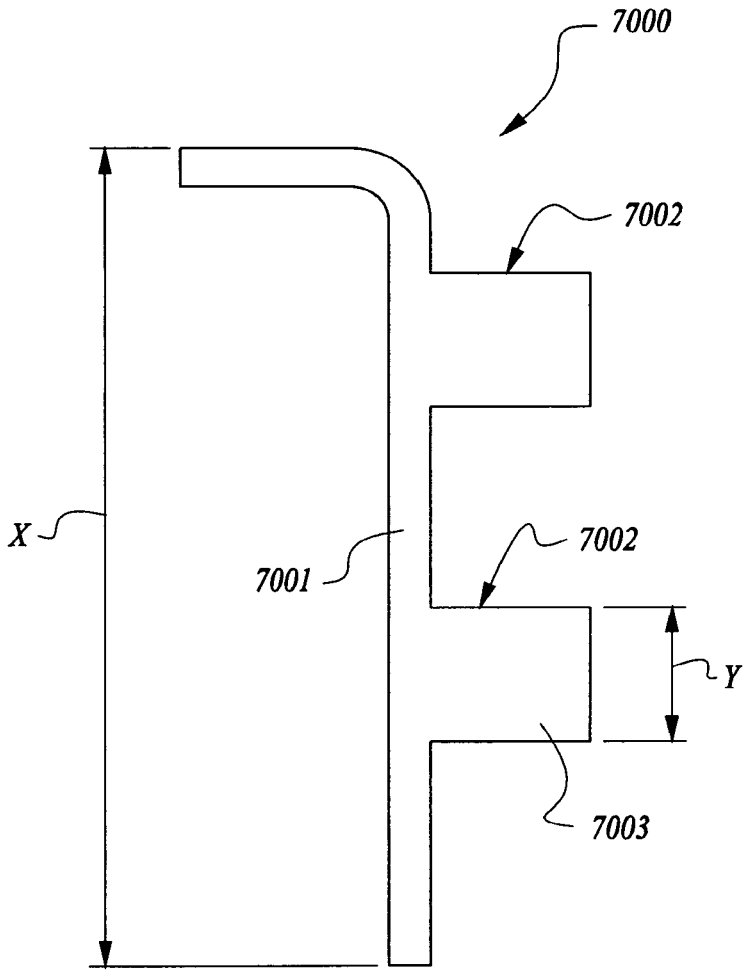
FIG. 7 shows a connecting-device in accordance with a further preferred embodiment of the present invention.

In FIG. 7 there is shown a connecting device 7000 which has an elongate member (EM) 7001 having a length along its longitudinal axis which depicted by double headed arrow X. Extending laterally out from the EM are two engaging elements 7002. The engaging elements have a portion 7003 which extends a distance Y which is parallel to the longitudinal axis of the EM.

Figure 8:
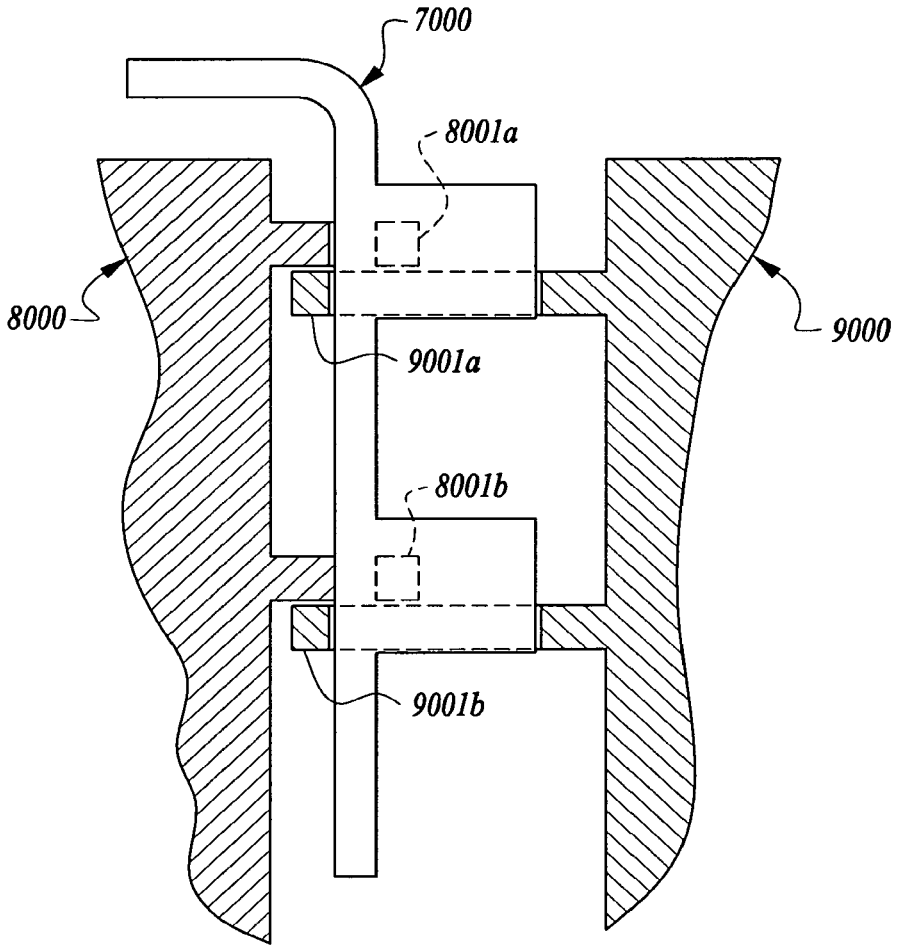
FIG. 8 shows a partial cross sectional side view of two adjacent barrier sections in accordance with an alternative preferred embodiment of the present invention.

In FIG. 8 there are shown two adjacent barrier sections 8000 and 9000 which form part of a barrier (not shown). The barrier sections 8000 and 9000 each have two connecting regions 8001*a*, 8001*b* and 9001*a*, 9001*b* respectively. The connecting regions 8001*a*, 8001*b* and 9001*a*, 9001*b* are connected to one another via a connecting device 7000 which is the same as that shown in FIG. 7. It will be appreciated that the connecting regions 9001*a* and 9001*b* of the barrier section 9000 are replicated on the opposite end of barrier section 8000 which is not shown. Similarly the connecting regions 8001*a* and 8001*b* on barrier section 8000 are mirrored on the opposite end of barrier section 9000 which is not shown.

Figure 9:
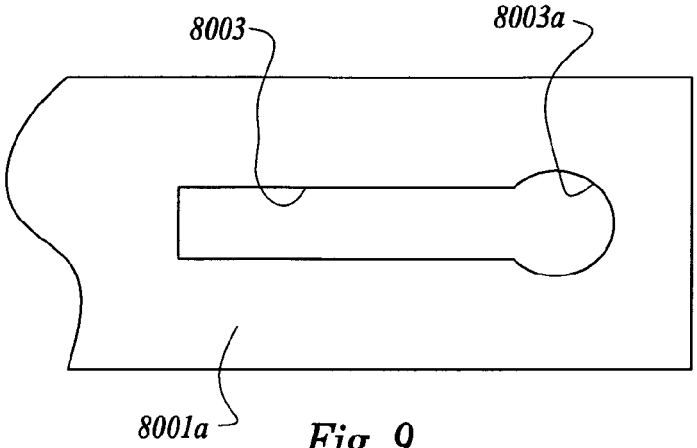
FIG. 9 shows a plan view of the top and bottom connecting-regions on the left barrier section shown in FIG. 2.

The connecting regions 8001*a* and 8001*b* are identical and are depicted in FIG. 9 which shows connecting region 8001*a*. The connecting region 8001*a* has a CDRP in the form of a slot 8003 with a bulbous semi-circular end 8003*a* which receives the EM 7001. The slot 8003 receives the engaging elements 7003. The slot 8003 resembles a keyhole in shape.

Figure 10:
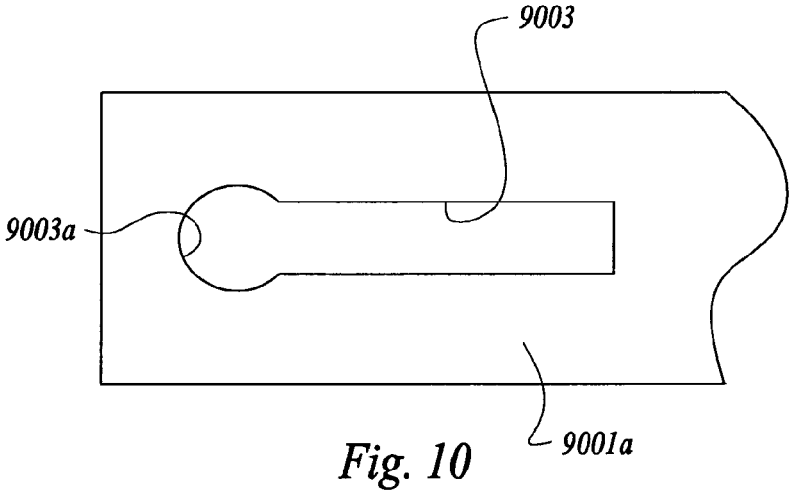
FIG. 10 shows a plan view of the top and bottom connecting-regions on the right barrier section shown in FIG. 2.

The connecting regions 9001*a* and 9001*b* are also identical to one another and are depicted in FIG. 10. The connecting region 9001*a* has a CDRP in the form of a slot 9003 extending from a bulbous semi-circular end 9003*a* which receives the EM 7001 (not shown). The slot 9003 receives the engaging elements 7003 (not shown).

Figure 11:
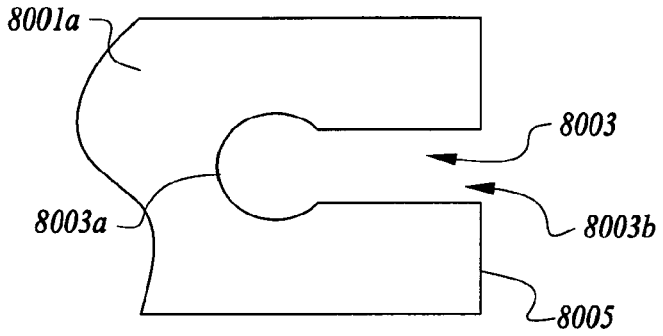
FIG. 11 shows a plan view of an alternative top and bottom connecting-regions on the left barrier section shown in FIG. 2 in accordance with a further embodiment.

FIG. 11 shows an alternate embodiment for the connecting regions 8001*a* and 8001*b* which can be used on the barrier section 8000 of FIG. 8. The connecting region 8001*a* has a CDRP in the form of a groove 8003 extending from a bulbous semi-circular end 8003*a* which receives the EM 7001 (not shown). The other end of the groove 8003 has a mouth portion 8003*b* is open to a distal face 8005 of the connecting region 8001*a*. The slot 8003 receives the engaging elements 7003 (not shown).

Figure 12:
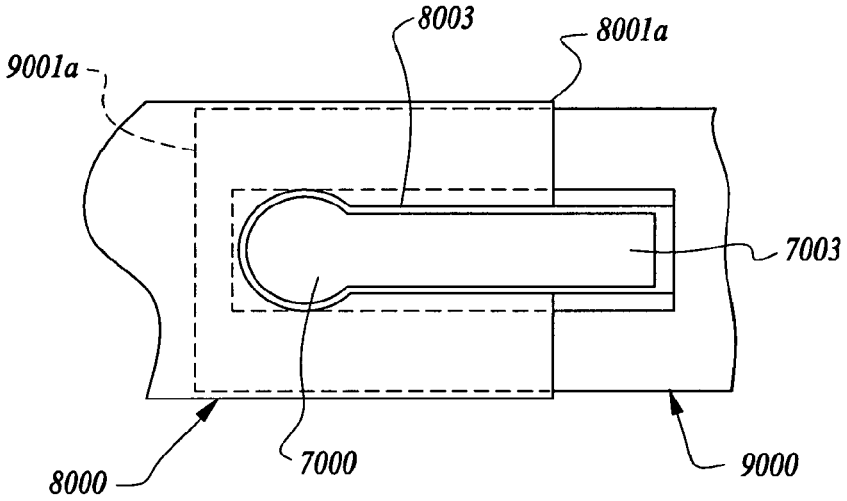
FIG. 12 shows a plan view of a two adjacent barrier sections which have an in-line relationship to one another.
Figure 13:
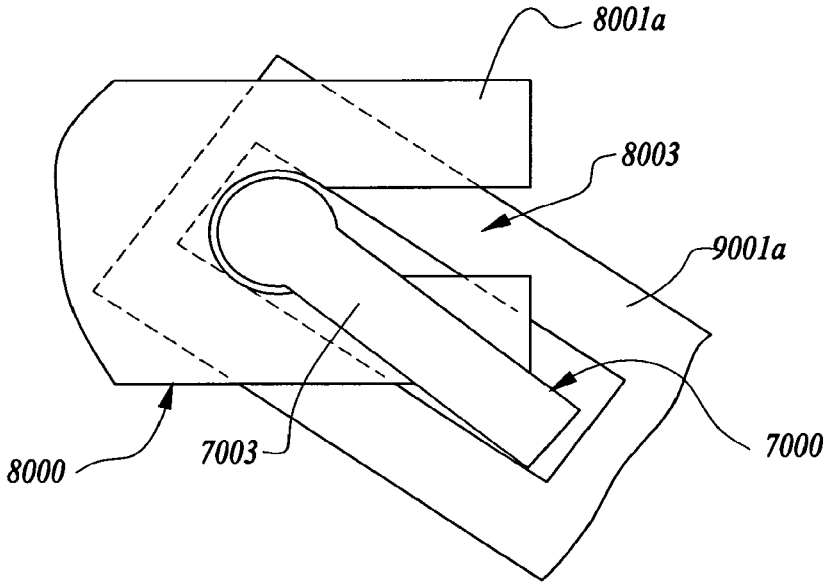
FIG. 13 shows a partial plan view of a two adjacent barrier sections which have an angled relationship to one another.

FIG. 12 shows barrier sections 8000 and 9000 connected via their respective connecting regions 8001*a* and 9001*a* and the connecting device 7000 so as to have an angled relationship to one another. In this arrangement the engaging elements 7003 of the connecting device 7000 rest on top of the connecting regions 8001*a* and 8001*b* and are not aligned with the slot 8003. Thus, it is just the EM 7001 which passes through and connects connecting regions 8001*a* and 8001*b* on the left barrier section 8000 with the connecting regions 9001*a* and 9001*b* on the right barrier section 9000. To achieve this angled relationship the connecting device 7000 passes through the respective connecting regions 8001*a*,8001*b* and 9001*a* and 9001*b* on the left and right barrier sections 8000, 9000 when the barrier sections are in an inline relationship. Then the connecting device 7000 is partially withdrawn so the engaging elements 7003 are no longer located within the connecting regions, the connecting device is then twisted so as the engaging elements 7000 no longer align with slot 8003*a*, so the connecting device can rest on top of connecting regions 8001*a* and 8001*b*. The barrier section 8000 can then be pivoted relative to barrier section 9000 (or vice versa) to effect an angled relationship there between.

Aspects of the present invention have been described by way of example only and it should be appreciated that modifications and additions may be made thereto without departing from the scope of the appended claims.

What we claim is:

1. A Roadway barrier apparatus comprising, in combination:

a first barrier section having a first barrier section end including a first barrier section upper protrusion with an upper connecting region defining a connecting device receiving portion and a first barrier section lower protrusion with a lower connecting region defining a connecting device receiving portion, said first barrier section upper protrusion and said first barrier section lower protrusion being spaced from one another with the connecting device receiving portion of said upper connecting region of the first barrier section upper protrusion positioned above the connecting device receiving portion of said lower connecting region of the first barrier section lower protrusion, said connecting device receiving portions being openings;

a second barrier section having a second barrier section end including a second barrier section upper connecting region defining a connecting device receiving portion and a second barrier section lower protrusion with a lower connecting region defining a connecting device receiving portion, said second barrier section upper protrusion and said second barrier section lower protrusion being spaced from one another with the connecting device receiving portion of said upper connecting region of the second barrier section upper protrusion positioned above the connecting device receiving portion of said lower connecting region of the second barrier section lower protrusion, said connecting device receiving portions of the first and second barrier sections being openings, the upper protrusion of said first barrier section and the upper protrusion of the second barrier section being in overlapping relationship and the lower protrusion of said first barrier section and the lower protrusion of said second barrier section being in overlapping relationship, with the openings of said overlapping first and second barrier sections upper and lower protrusions located along a common vertical axis; and a connecting device including an elongated member and engaging elements attached to said elongated member, projecting outwardly therefrom in substantially the same direction and spaced from one another, said connecting device positionable in said openings and movable between a lower position wherein said engaging elements engage the overlapping upper and lower protrusions of both said first barrier section and said second barrier section to maintain said first and the second barrier sections in alignment and an upper position wherein said engaging elements are removed from said openings whereby said first barrier section and said second barrier section may be pivoted about the elongated member, the opening in the upper protrusions of the first and second barrier sections each comprising a slot having an end for receiving the elongated member and which enables a lower one of the engagement elements to be inserted and pass therethrough, at least the lower one of the engaging elements having a portion extending substantially parallel to the elongated member, the connecting regions of the lower protrusions of the first and second barrier sections each having at least two separate openings, one of said two separate openings accommodating said elongated member and the portion positioned in the other of the two separate openings when the connecting device is in the lower position.

2. The roadway barrier apparatus according to claim 1 wherein the opening in the upper protrusion of said first barrier section comprises a slot having a bulbous end for receiving said elongated member.

3. The roadway barrier apparatus according to claim 2 wherein said second portion has a length substantially 15-20% of the length of the elongated member.

4. The roadway apparatus according to claim 2 wherein said elongated member is positioned in the bulbous end of said slot.

5. The roadway barrier apparatus according to claim 1 wherein said engaging elements are in the form of a dog leg.

6. The roadway barrier apparatus according to claim 1 wherein at least one engaging element has a first portion extending substantially orthogonal to said elongated member and a second portion extending substantially parallel to said elongated member, said elongated member positioned in one of said two separate openings and the second portion positioned in the other of said two separate openings when the connecting device is in said lower position.

* * * * *